United States Patent [19]

Vann

[11] 4,269,278

[45] May 26, 1981

[54] METHOD AND APPARATUS FOR COMPLETING A SLANTED WELLBORE

[75] Inventor: Roy R. Vann, Artesia, N. Mex.

[73] Assignee: Peabody Vann, Houston, Tex.

[21] Appl. No.: 110,507

[22] Filed: Jan. 8, 1980

Related U.S. Application Data

[63] Continuation of Ser. No. 842,565, Oct. 17, 1977, Pat. No. 4,194,577.

[51] Int. Cl.[3] ..... E21B 43/118

[52] U.S. Cl. ..... 175/4.51

[58] Field of Search ..... 175/4.51, 4.52, 4.57, 175/77, 81; 166/297, 55, 50

[56] References Cited

U.S. PATENT DOCUMENTS

| | | | |
|---|---|---|---|
| 2,530,833 | 11/1950 | Martin | 175/4.56 |
| 2,935,944 | 5/1960 | Sweetman | 175/4.51 |
| 3,045,748 | 7/1962 | Schramm | 175/4.51 |
| 3,367,626 | 3/1967 | Bielstein | 166/55 |
| 4,153,118 | 5/1979 | Harr | 175/4.51 |

*Primary Examiner*—William F. Pate, III

*Attorney, Agent, or Firm*—Marcus L. Bates

[57] ABSTRACT

A wellbore is formed with the lower marginal end portion thereof being turned substantially horizontally, thereby exposing a relatively large surface area of the pay zone to the cased borehole. A jet perforating gun has a member extending radially therefrom and into close proximity to the inside peripheral wall surface of the casing, and the shaped charges thereof are oriented so that they fire and perforate in a direction opposed to the arm. The gun is run downhole into proximity of the pay zone with the shaped charges being directed in a substantially downward direction so that when the gun is fired, the casing is perforated with the perforations extending downwardly into the hydrocarbon bearing formation. This expedient enables the perforated formation to be produced without flowing any of the unconsolidated formations into the wellbore.

9 Claims, 7 Drawing Figures

P
60°
90°
180°

METHOD AND APPARATUS FOR COMPLETING A SLANTED WELLBORE

REFERENCE TO RELATED APPLICATION

The instant application is a continuation of patent application Ser. No. 842,565, filed Oct. 17, 1977, entitled: "METHOD FOR COMPLETING A SLANTED WELLBORE," now U.S. Pat. No. 4,194,577 issued Mar. 25, 1980.

BACKGROUND OF THE INVENTION

In the art of drilling wellbores for the purpose of producing hydrocarbon bearing formations found downhole therein, it is often advantageous to slant the lower marginal end of the borehole so that the pay zone is penetrated substantially horizontally and at a considerable distance radially away from the drilling rig. One of the advantages found in slanting a borehole in this manner is to enable the pay zone to be entered at a number of different locations radially spaced about the drilling rig so that a plurality of the boreholes can be formed from a common drilling location. This technique is especially advantageous when the cost of moving the drilling rig is considerable, as for example, an offshore drilling rig.

Another advantage derived from slanting the lower marginal end of the borehole horizontally respective to the pay zone is that a tremendous amount of surface area of the borehole is located directly in the pay zone; and therefore, a greater number of perforations can be formed which extend back up into the hydrocarbon bearing formation, thereby achieving a much greater production rate from the pay zone.

Where the pay of the slanted borehole is located in an unconsolidated type strata, the loose particles of the formation tend to flow through the perforations and thereby bring about many undesirable and complicated production problems which are difficult to overcome. Accordingly, it would be desirable to be able to perforate a slanted borehole in such a manner that the formation is penetrated only in a predominantly downward direction; and accordingly, flow of unconsolidated material must therefore occur in an upward direction, thereby causing the solid matter which constitutes the pay zone to tend to gravitate downwardly and remain insitu respective to the formation, and this is the primary subject of this invention.

SUMMARY OF THE INVENTION

Apparatus for completing a lower slanted marginal end of a cased wellbore by running a jet perforating gun downhole into proximity of the hydrocarbon bearing formation to be completed, and orientating all of the jet charges of the gun to fire in a downward direction so that production from the perforated pay zone must flow upwardly through the perforations before entering the slanted portion of the borehole.

More specifically, this invention comprehends a jet perforation gun having the shaped charges thereof oriented to fire in substantially the same direction radially away from the gun in a substantially narrow angle of divergence respective to one another. Casing engaging means in the form of a member which is attached to the gun housing and extends radially away from the gun in opposition to the oriented shaped charges is included in the invention. The length of the arm is of a value to cause the free end thereof to extend into close proximity of the inside peripheral wall surface of the casing. This expedient distributes the mass of the gun in such a manner that the center of gravity thereof causes the gun to gravitate into a position whereby the members thereof seek an upright position, while the shaped charges thereof seek an inverted position, and the shaped charges are accordingly aligned respective to the slanted borehole such that when detonated, they fire downwardly through the casing wall and into the formation, rather than horizontally or upwardly thereinto.

In one form of the invention, a tubing string is connected to a swivel, the swivel is connected to a ported sub, with the sub being connected to a gun firing head, while the gun firing head is connected to detonate all of the shaped charges of the gun. A weighted object is circulated down through the tubing string, through the swivel, and impacts against the gun firing head, with circulation occurring down the tubing string, through the ported sub, and back up the casing annulus. The impact of the weighted object against the gun firing head detonates the individual shaped charges. The gun includes a plurality of charge carriers which are connected in series relationship so that a substantial length of the slanted borehole can be perforated and production thereafter controlled to avoid producing the unconsolidated material of the formation.

Accordingly, a primary object of the present invention is the provision of a system by which an unconsolidated formation of a hydrocarbon producing wellbore can be completed.

Another object of the invention is to disclose and provide an apparatus for completing a wellbore so that fluid can be produced from an unconsolidated formation without producing solid material therefrom.

A further object of this invention is to disclose and provide an apparatus by which the shaped charges of a jet perforating gun are oriented to fire in a predominantly downwardly direction when the gun is placed downhole in a slanted borehole.

A still further object of this invention is to disclose and provide a gravity oriented perforating system for a slanted wellbore by which the perforations are caused to extend in a predetermined direction away from the wellbore.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figures 1, 2, 3, 4, 5, 6, 7:
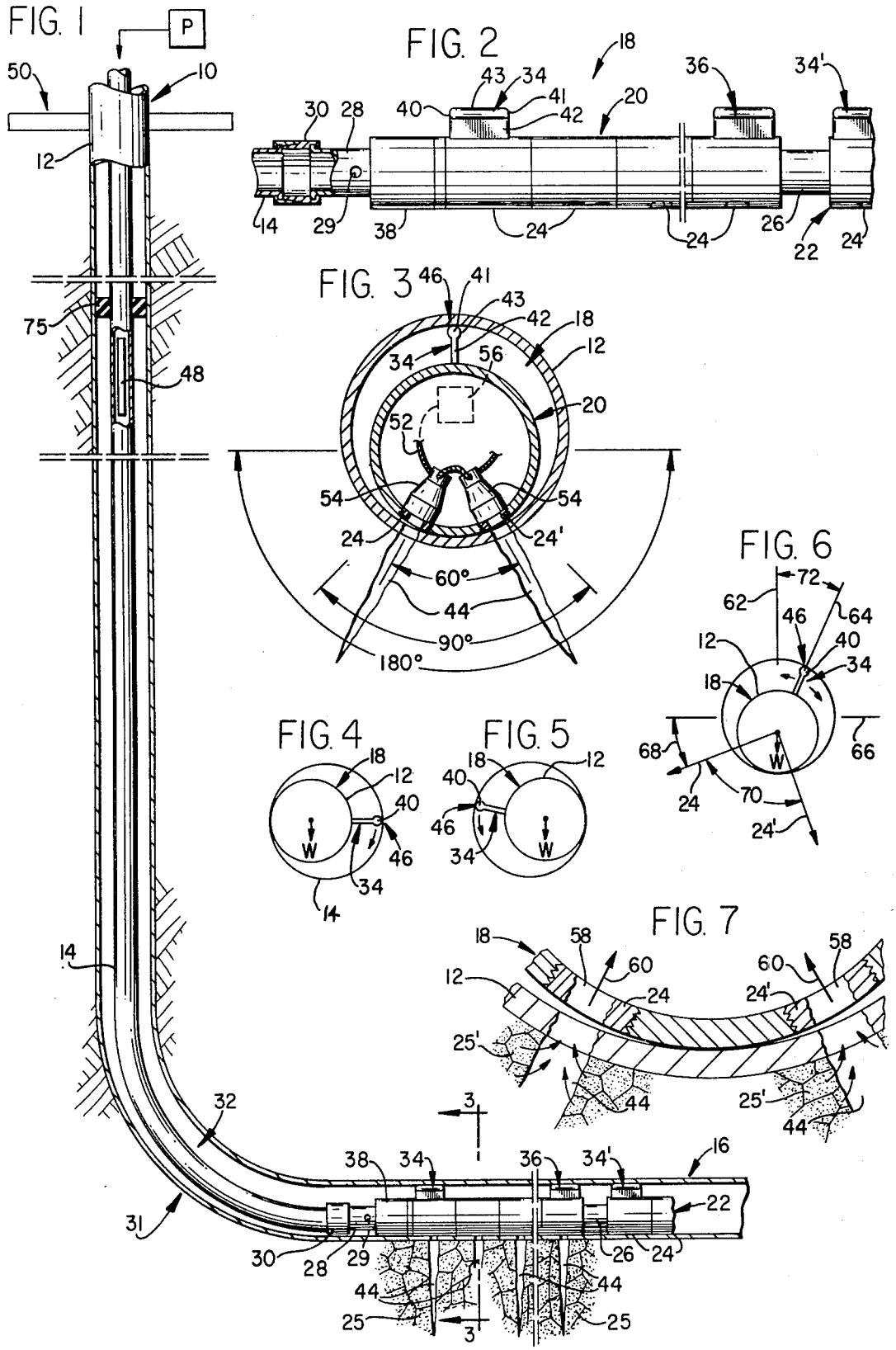
FIG. 1 diagrammatically illustrates a cross-sectional view of a slanted borehole having apparatus made in accordance with the present invention associated therewith.
FIG. 2 is an enlarged, broken, part cross-sectional, elevational view of part of the apparatus disclosed in FIG. 1.
FIG. 3 is an enlarged, cross-sectional view taken along line 3—3 of FIG. 1.
FIGS. 4, 5, and 6 diagrammatically illustrate various different exaggerated configurations of the apparatus disclosed in FIG. 3; and, FIG. 7 is a fragmented, enlarged, cross-sectional view of a casing of a wellbore which has been perforated in accordance with the present invention.

FIG. 1 diagrammatically illustrates a borehole or wellbore 10 which has a casing 12 extending downhole into the earth. A tubing string 14 is more or less concentrically arranged respective to the casing and also extends downhole through the borehole and into proximity of a hydrocarbon containing formation. The lower marginal end 16 of the borehole has been slanted, and in the illustrative view of FIG. 1, it will be appreciated that the degree of the slant has caused the lower end of the borehole to assume a path which is essentially horizontal, while the upper end of the borehole is essentially vertical.

As seen in FIGS. 1–3, a jet perforating gun 18, made in accordance with the present invention, is located downhole in the slanted portion of the borehole. The gun includes a charge carrier 20 within which there is disposed a plurality of shaped jet perforating explosive-type charges. The individual shaped charges are made in accordance with the prior art. A plurality of other charge carriers 22 can be series connected with respect to the charge carrier 20. The charge carrier is provided with the usual threaded plugs 24 which form a closure member for a port formed therewithin, through which the hot plasma jet exits whenever the gun is detonated.

As seen in FIGS. 1 and 2, a sub 26 interconnects each of the charge carriers. A sub 28 is provided with radially spaced apart ports 29 and is connected to the lower end of the tubing string by means of a swivel 30. The swivel 30 can take on a number of different forms so long as it enables relatively low friction axial rotation between the charge carrier and the tubing string.

Numeral 31 of FIG. 1 diagrammatically illustrates the bend of the borehole which, of course, occurs over a length of several hundred feet as the vertical upper marginal end of the borehole is slanted towards the illustrated horizontal lower marginal end of the borehole. In this respect, the term "slanted borehole," as used throughout this disclosure, is intended to relate to a borehole which is sloped away from a vertical position sufficiently to enable the gun apparatus of the present invention to bear against the inside peripheral wall surface thereof with sufficient gravitational force to cause the gun to be oriented into an upright position. The term "upright position," as used herein, is intended to mean that the shaped charges of the gun come to bear in a substantial downhole direction as contrasted to an uphole direction.

The outer housing of the charge carrier is rigidly connected to an outwardly directed member 34 and 36, which is affixed to the housing and extends in opposition to the shaped charges, with the free outer end portion of the member being sized such that it is located in close proximity to the inside peripheral wall surface of the casing when the gun is in the upright position.

In the illustration of FIGS. 1–6 of the drawings, the individual charge carriers 20, 22 of the gun are illustrated as each having a forward and rearward casing engaging member 34 and 36, 34′ and 36′ (not shown).

A gun firing head 38 is affixed to the forward or uphole end of the uppermost charge carrier and is connected in affixed relationship to the ported sub 28. The forward end 40 and rear end 41 of the orientating members are preferably curved in order to avoid engagement with any irregularity formed along the casing wall. A web 42 is rigidly affixed to the charge carrier housing and supports a load bearing enlargement 43 at the free end thereof.

In FIG. 1, the hydrocarbon bearing formation 25 has been penetrated at 44 by the action of the jet charges. The shaped charges have penetrated the plugs to produce a plasma jet of hot gases and vaporized metal which form the tunnels 44 in the manner of FIGS. 1, 3, and 7.

In FIGS. 4, 5, and 6, the operation of the gravity, orientating, perforating system of the present invention is illustrated. In particular, FIG. 4 discloses the position on the inside wall surface 46 of the casing 12 which is engaged by the casing engaging member 34 should the gun tend to axially rotate respective to the tubing 14 as the gun is run downhole. As seen in FIG. 4, should the gun tend to climb the sidewall of the casing, enlargement 44 will be rotated into engagement with the casing wall at 46, thereby preventing any further rotation. At the same time, the mass of the gun tends to gravitate the gun back into the upright position seen illustrated in FIGS. 1–3.

In FIG. 5, the gun has climbed the opposed sidewall of the casing, and the outer enlargement 43 of the casing engaging member again has contacted the inside peripheral wall surface of the casing at 46 whereupon the mass W of the gun gravitates the apparatus in a manner such that it axially rotates back into the upright position.

FIG. 6 illustrates that slight axial rotation of the gun has occurred as it is located nearly on bottom dead center of the slanted portion of the borehole. As seen in FIG. 6, should the gun for some reason or another further axially rotate in either direction, the enlargement 43 of the casing contacting member will engage the inside casing wall at 46 to prevent further rotation thereof. Since the charges are aligned to perforate in a downward direction in FIG. 6, the term "upright position" applied to this geometrical configuration of the illustration therein.

In FIG. 1, a weighted object 48, in the form of a sinker bar, is circulated downhole by means of pump P located on drilling platform 50.

In FIG. 3, prima cord 52 is illustrated as being looped through each of the apertures located rearwardly within the shaped charges 54 in a conventional manner. Detonating means 56 forms part of the firing head and explodes the prima cord in response to the firing head being contacted or impacted by the sinker bar 48 in accordance with my previously issued U.S. Pat. Nos. 3,706,344 and 4,009,757.

In FIG. 7, the perforating gun of the present invention has been detonated, thereby forming holes 58 through the aluminum plugs 24, thereby forming the before mentioned tunnels 44. Upward flow of hydrocarbons from formation 25 is generally illustrated by the arrow at numeral 60. The unconsolidated formation 25′ will flow in the direction of arrow 60 should the individual perforations of the pay zone be overproduced.

Looking again now to FIG. 6, numeral 62 indicates a vertical line taken along the slanted portion 16 of the borehole. Numeral 64 indicates the maximum acceptable angular displacement 72 of the casing engaging member 34 from a vertical plane 62. Numeral 66 indicates a horizontal plane taken through the casing at 16, while numerals 24, 24′ indicate the direction of the hot gases which result from the detonated shaped charges, and numeral 68 indicates the minimum angle between one of the hot streams of gas from one of the shaped charges and the horizontal. Numeral 70 is the angular displacement between pairs of shaped charges when more than one shaped charge is incorporated in radially spaced relationship in the illustrated manner of FIG. 3, for example.

A packer 75 can be employed for completing the well in accordance with the method and apparatus of the present invention.

OPERATION

In carrying out the method of the present invention, a borehole having a vertical, upper marginal end and a slanted, lower marginal end portion is formed into the ground, and the casing 12 is cemented into place so that the casing extends downhole through the formation 25 to be completed.

The gun is made up and attached to the tubing string 14 in the illustrated manner of FIG. 1 so that the perforating apparatus can freely axially rotate with a minimum of frictional resistance respective to the tubing. The gun is run downhole on the end of the tubing string and positioned adjacent to and within the formation to be completed. A sinker bar 48 is pumped down the tubing string by connecting pump "P" to the uphole end of the tubing string and pumping fluid down the string, out through ports 29, up the casing annulus, and across the unset packer.

The sinker bar 48 impacts against the gun firing head 38, thereby detonating the prima cord 52 and causing all of the shaped charges to explode. The shaped charges penetrate the plugs, casing, and extend back up into the formation in the illustrated manner of FIGS. 1, 3, and 7. The gun can be removed from the borehole, and the well placed on production by utilizing any number of different completion techniques.

Where deemed desirable, the unset packer 75 can be employed by setting the packer immediately following perforation and the gun left downhole with production occurring through ports 29 of the sub 28. Alternatively, permanent completion techniques can be carried out in accordance with my previously issued U.S. Pat. No. 3,706,344 in conjunction with the present apparatus.

The present invention enables an almost unlimited number of perforations to be made along the slanted portion of a borehole, thereby effecting communication over an extremely long length of borehole formed into the formation 25, which advantageously enables a large production rate to be achieved from relatively thin pay zones.

As seen in FIGS. 4–6, the gun is gravitated into the upright position because of the distribution of mass respective to the casing engaging member and the center of gravity of the gun. As particularly seen in FIG. 6, the gun is gravitated toward the upright position within the limits of the angle indicated by numeral 72. The relative location of the pairs of shaped charges are arranged respective to one another to penetrate the formation along the indicated angle noted by numeral 70. Accordingly, when the gun is at its maximum angle of rotation 72, there is always a minimum angle 68 at which the tunnels extend back into the formation with respect to the horizontal 66. Therefore, production must always occur from the pay zone uphole into the casing.

In practicing the present invention, it is desired that the tunnels 44 extend downwardly from the casing so that any unconsolidated material 25' remains in situ because it is held gravitated into its original position. For this reason, a large number of perforations 44 are preferred so that the aggregate rate of production of the sum of the flow through the perforations is substantial, yet the flow is held to a value required to avoid flowing any of the unconsolidated matter into the borehole.

The present invention provides an improved apparatus for gravel packing the formation contiguous to the casing since the gravel can be forced downhole where it will gravitate into the downwardly directed tunnels 44.

The present invention can also be used in conjunction with a wireline, wherein the wireline acts as the swivel 30, and with the gun being a through tubing gun which is run through the tubing, downhole onto location by pumping the gun with pump P. In this instance, the tubing 14 must be considered representative of the wireline while the ported sub 28 is eliminated since the gun is circulated down through the tubing with fluid returning up through casing annulus. The gun is fired electrically using known wireline techniques.

I claim:

1. Apparatus for completing a lower marginal end of a cased slanted borehole comprising a perforating gun for perforating the borehole, said gun having a main housing within which there is formed a plurality of shaped charges for perforating a casing;

a casing engaging member attached to said main housing and extending radially away from said main housing in opposition to the direction in which said shaped charges are oriented to fire;

a swivel means, a tubing string, a firing head attached to the uphole end of said gun, means associated with said firing head for detonating each of said shaped charges, said shaped charges being oriented respective to one another and to said main housing to fire in a direction which forms an included angle of less than 180°, said gun is connected to said swivel means and said swivel means is connected to said tubing string; whereby, the gun can be run downhole and into the slanted portion of the borehole, and thereafter the firing head can be actuated to detonate the shaped charges to cause the casing in the slanted part of the borehole to be perforated in a downward direction.

2. The apparatus of claim 1 and further including a sub, means by which said sub is connected in series relationship respective to said swivel and said firing head, an outlet port formed in said sub by which fluid can flow through said tubing and through said outlet port, said gun head includes means for detonating said shaped charges responsive to impact, so that an object can be circulated downhole into abutting engagement with the firing head to thereby cause the gun head to detonate the shaped charges.

3. The apparatus of claim 2 wherein said main housing has a diameter substantially less than the diameter of the borehole so that the axial centerline of the gun is located below the axial centerline of the borehole;

said casing engaging member extends radially away from said main housing and has a radial dimension substantially equal to the difference in diameter between the main housing and borehole diameters.

4. The apparatus of claim 3 wherein pairs of shaped charges are arranged to fire along a diverging path which forms an acute angle therebetween, with a bisecting line drawn therebetween extending through the radial plane within which the casing engaging member is oriented.

5. The apparatus of claim 4 wherein there are two longitudinally spaced apart casing engaging members attached to the exterior of the housing, each casing engaging member being a relatively flat member which has a longitudinal length significantly less than the length of said main body.

6. In a cased borehole which extends substantially vertically downhole into the ground to form the upper marginal end thereof and then turns substantially horizontal to form the lower marginal end thereof, the combination with said borehole of a casing gun for completing the borehole such that the gun perforates the borehole casing in a substantially downward direction respective to the horizontal surface of the earth;

said gun having a main housing of generally cylindrical configuration, means by which a plurality of shaped charges are mounted within said housing, each said shaped charge being oriented respective to said main housing to fire along a path which extends in a downward direction respective to a plane passing through the longitudinal axial centerline of the main housing;

said main housing being substantially smaller in diameter relative to said borehole so that the axial centerline of the gun lies below the axial centerline of the borehole when the gun is located in and gravitates to the bottom of said lower marginal end of the borehole;

an upwardly extending guide means having a fixed end attached to said main housing and a free end slightly spaced from the casing wall such that the guide means extends radially away from the main housing and has a length which is slightly less than the difference in the length of the main housing and borehole diameters; said guide means being located in a plane which extends in opposition to the direction that the shaped charges are oriented to fire so that the shaped charges are biased into a position to penetrate the casing in a downward direction;

said gun includes means forming a gun firing head by which said shaped charges can be detonated remotely; a swivel means; and a tubing string;

said main housing being supported from the lower end of said tubing string by said swivel means so that said main housing of said gun can be rotated about the axial centerline thereof and respective to said tubing string;

whereby the gun can be run downhole into the horizontal length of the borehole, while the guide means orients the shaped charges to fire in a downward direction, so that when the gun firing head is actuated, the casing is perforated in a downward direction.

7. The combination of claim 6, and further including a sub, means by which said sub is connected in series relationship respective to said swivel means and firing head, an outlet port formed in said sub by which fluid can flow through said tubing and through said outlet port, said gun head includes means by which it detonates said shaped charges responsive to impact, so that an object can be circulated downhole into abutting engagement with the firing head to thereby detonate the shaped charges.

8. The combination of claim 7, and wherein pairs of shaped charges are arranged to fire along a diverging path which forms an acute angle therebetween, with a bisecting line drawn therebetween extending through a radial plane within which the guide means is oriented.

9. The combination of claim 8, wherein there are two spaced guide means attached to said housing, each of said guide means being a relatively flat member which has a longitudinal length significantly less than the length of said main body.

* * * * *